United States Patent [19]

Grushka

[11] Patent Number: 4,858,413

[45] Date of Patent: Aug. 22, 1989

[54] PROFILE FOR FURNITURE

[76] Inventor: Dov Grushka, P.O. B. 3069, Hod Hasharon, 45247, Israel

[21] Appl. No.: 144,036

[22] Filed: Jan. 15, 1988

[51] Int. Cl.[4] ..... E04C 2/38; E04C 2/44

[52] U.S. Cl. ..... 52/823; 52/730

[58] Field of Search ..... 52/821, 822, 823, 730, 52/732; 108/27

[56] References Cited

U.S. PATENT DOCUMENTS

| | | | |
|---|---|---|---|
| 2,564,386 | 8/1951 | Webb | 52/823 |
| 2,934,180 | 4/1960 | Hammitt et al. | 52/732 |
| 3,349,533 | 10/1967 | Gregoire | 52/823 |
| 3,363,390 | 1/1968 | Crane et al. | 52/823 |
| 3,834,101 | 9/1974 | Wilder et al. | 52/823 |

*Primary Examiner*—David A. Scherbel
*Assistant Examiner*—Michele A. Van Patten
*Attorney, Agent, or Firm*—Charles E. Temko

[57] ABSTRACT

The present invention relates to safety edge-forming elements for the insertion of planar parts of furniture, the elements comprising two opposite longitudinally extending walls being rounded at the outside periphery thereof, and comprising positive wall engaging means for said planar parts of furniture.

2 Claims, 1 Drawing Sheet

PROFILE FOR FURNITURE

BACKGROUND OF THE INVENTION

The present invention relates to edge-forming means for furniture.

In many cases, it is important, particularly in connection with furniture to be used in children's rooms, that the corners and exposed edges of such furniture be rounded or have such a shape that contact with said edges should not cause injury. However, most commercially available pieces of furniture are not constructed in such manner, or if they are, they are rather complicated to erect.

SUMMARY OF THE INVENTION

It has therefore, been desirable to construct furniture or an edge-forming means which may be a part thereof, and achieve the above-mentioned end in a simple and uncomplicated manner and at reasonable cost of production.

The present embodiment of the invention thus consists of edge-forming means for the insertion of planar parts of furniture which comprise two opposite longitudinally extending walls having rounded outer edges and being provided with the following parts located from the inner to the outer peripheries comprising:

a. Rigid teeth for engaging edge portions of the furniture extending into an open space between said longitudinally extending walls;

b. A flexible plate connecting said walls to each other;

c. a flexible projection extending from each wall into said open space; and d. a rigid plate slideably engaged betewen said walls to prevent disengagement of said teeth;

all of said parts being suitably distanced from each other and extending longitudinally along said walls, the flexible projection and the upper end of each wall being formed in such manner that together they form a hollow space adapted for the insertion of said rigid plate.

In a modification of the edge-forming means according to the present invention, the flexible plate is supplemented by two flexible projections extending into the open space between said walls and selectively touching each other.

The edge forming means according to the present invention can be made of any suitable material, but is preferably made of a suitable plastic material.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
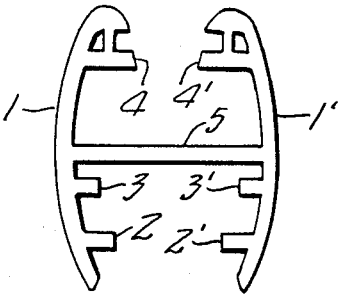
FIG. 1 is an end view of an edge-forming means in accordance with the disclosed invention.
Figure 2:
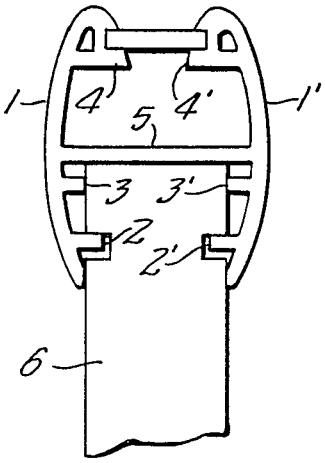
FIG. 2 is a similar end view of the edge-forming means shown in FIG. 1 with inserted furniture.
Figure 3:
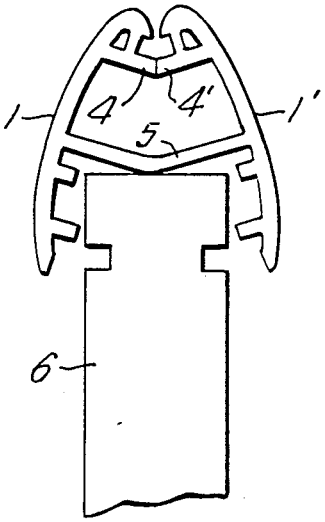
FIG. 3 is a similar view corresponding to that shown in FIGS. 1 and 2 showing the assembly of the furniture within the edge-forming means.

In accordance with the invention, the edge-forming means illustrated in FIGS. 1 to 3, inclusive, comprises walls 1 and 1'. Along said walls 1 and 1' extend teeth 2, 2', 3 and 3', as well as projections 4 and 4'. Walls 1 and 1' are connected by a flexible plate 5.

Furniture 6 is provided with grooves 7 and 7' and is held by teeth 2, 2', 3 and 3'. A rigid plate 8 is held by projections 4 and 4' and ends 9 and 9' of walls 1 and 1', respectively.

Figure 4:
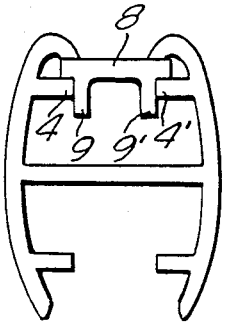
FIG. 4 is an end view of a second embodiment of the invention.

The embodiment illustrated in FIG. 4 is similar to that illustrated in FIGS. 1 to 3 with the exception that projections 4 and 4' have a modified form so that they may be held by plate 8' provided with two legs 9 and 9'.

Figure 5:
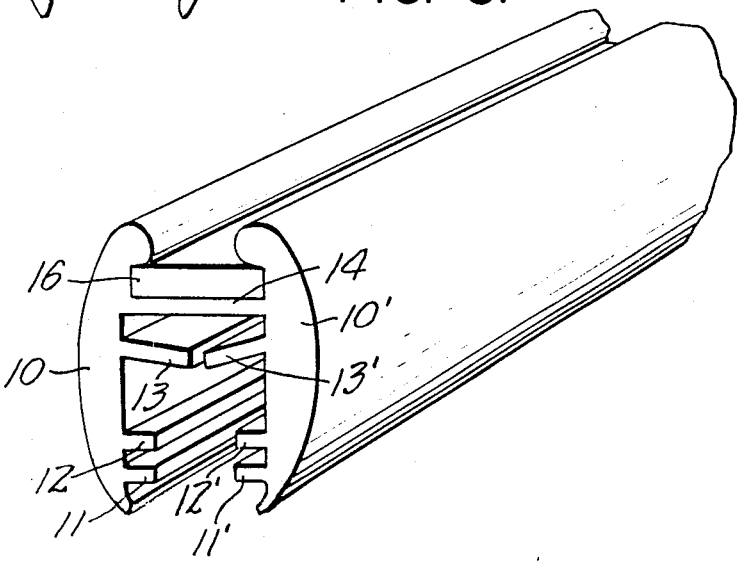
FIG. 5 is an end view showing a third embodiment of the invention.

The embodiment illustrated in FIG. 5 comprises walls 10 and 10'. Along said walls extend teeth 11, 11', 12 and 12', as well as flexible projections 13 and 13'. Walls 10 and 10' are connected by a flexible plate 14 which, together with rounded ends 15 and 15' of walls 10 and 10', respectively, hold rigid plate 16. The furniture to be held by teeth 11, 11', 12 and 12', and projections 13 and 13' is not illustrated.

I claim:

1. An edge forming means for the reception of planar parts of furniture comprising an elongated molding of flexible material, said molding including first and second longitudinally extending walls having outer rounded edges, and inner and outer surfaces; rigid teeth extending from said inner surface of each of said walls toward each other; a flexible plate interconnecting said inner surfaces of each of said walls; each of said walls defining a longitudinally extending recess disposed outwardly of said flexible plate; and a rigid plate having longitudinal edges engaging said recess to urge said teeth toward each other.

2. In combination, an edge forming means for the reception of planar parts of furniture comprising an elongated molding of flexible material, said molding including first and second longitudinally extending walls having outer rounded edges, and inner and outer surfaces; rigid teeth extending from said inner surface of each of said walls toward each other; a flexible plate interconnecting said inner surfaces of each of said walls; each of said walls defining a longitudinally extending recess disposed outwardly of said flexible plate; and a rigid plate having longitudinal edges engaging said recess to urge said teeth toward each other; and a planar wall of a piece of furniture engaged between said wall, said planar wall having elongated grooves engaged by said teeth, whereby to maintain said edge-forming means upon said planar wall.

* * * * *